US009657433B2

(12) United States Patent
Doh et al.

(10) Patent No.: US 9,657,433 B2
(45) Date of Patent: May 23, 2017

(54) DRYER AND CONTROLLING METHOD THEREOF

(75) Inventors: Young Jin Doh, Jinhae-si (KR); Jae Seok Kim, Changwon-si (KR); Seog Ho Go, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 1235 days.

(21) Appl. No.: 12/297,182

(22) PCT Filed: Apr. 13, 2007

(86) PCT No.: PCT/KR2007/001796

§ 371 (c)(1),
(2), (4) Date: Nov. 30, 2009

(87) PCT Pub. No.: WO2007/119969

PCT Pub. Date: Oct. 25, 2007

(65) Prior Publication Data

US 2010/0064546 A1 Mar. 18, 2010

(30) Foreign Application Priority Data

Apr. 14, 2006 (KR) ..... 10-2006-0034062
Apr. 14, 2006 (KR) ..... 10-2006-0034064

(51) Int. Cl.
*D06F 58/28* (2006.01)

(52) U.S. Cl.
CPC ..... *D06F 58/28* (2013.01); *D06F 2058/2838* (2013.01)

(58) Field of Classification Search
CPC ..... D06F 2058/28; D06F 2058/2816; D06F 58/28; D06F 2058/2838
USPC ..... 34/494, 528, 536, 550, 132, 529, 543, 34/261, 572
See application file for complete search history.

(56) References Cited

U.S. PATENT DOCUMENTS 4,293,762 A * 10/1981 Ogawa ..... 392/470
4,385,452 A * 5/1983 Deschaaf ..... D06F 58/28 34/562
4,470,204 A * 9/1984 Wesley ..... 34/550
4,531,305 A * 7/1985 Nagayasu et al. ..... 34/445
4,738,034 A * 4/1988 Muramatsu et al. ..... 34/524
5,172,490 A * 12/1992 Tatsumi et al. ..... 34/488
5,245,764 A * 9/1993 Sung ..... 34/550
5,291,667 A * 3/1994 Joslin et al. ..... 34/526
5,301,438 A * 4/1994 Tanaka et al. ..... 34/550
(Continued)

FOREIGN PATENT DOCUMENTS

CN 1465764 A 1/2004
CN 1467333 A 1/2004
(Continued)

*Primary Examiner* — Jiping Lu
(74) *Attorney, Agent, or Firm* — Birch, Stewart, Kolasch & Birch, LLP

(57) ABSTRACT

The present invention relates to a dryer and a controlling method of a dryer, which can sense whether there is a malfunction or can precisely sense a drying rate of laundry. A dryer comprising a drum that laundry is stored in and a heater that supplies hot air to the drum, the dryer includes a sensing circuit that outputs a pulse signal based on contact with the laundry; and a micom that controls the dryer, wherein the micom determines a drying rate of the laundry or whether there is a malfunction in the dryer based on the pulse signal outputted from the sensing circuit.

7 Claims, 4 Drawing Sheets

(56) References Cited

U.S. PATENT DOCUMENTS

| | | | | | |
|---|---|---|---|---|---|
| 5,345,694 | A | * | 9/1994 | Hayashi | 34/550 |
| 5,347,727 | A | * | 9/1994 | Kim | 34/491 |
| 5,560,124 | A | * | 10/1996 | Hart et al. | 34/493 |
| 5,570,520 | A | * | 11/1996 | Huffington | 34/535 |
| 5,852,881 | A | * | 12/1998 | Kuroda et al. | 34/527 |
| 5,899,005 | A | * | 5/1999 | Chen et al. | 34/528 |
| 6,047,486 | A | * | 4/2000 | Reck et al. | 34/491 |
| 6,810,602 | B2 | * | 11/2004 | Kim et al. | 34/547 |
| 6,931,760 | B2 | * | 8/2005 | Yang | 34/491 |
| 6,983,552 | B2 | * | 1/2006 | Park | 34/549 |
| 6,996,920 | B2 | * | 2/2006 | Bang et al. | 34/494 |
| 7,127,832 | B2 | * | 10/2006 | Park et al. | 34/562 |
| 7,345,491 | B2 | * | 3/2008 | Pezier | 324/694 |
| 7,448,145 | B2 | * | 11/2008 | Kim | 34/562 |
| 7,900,374 | B2 | * | 3/2011 | Bae et al. | 34/491 |
| 7,971,371 | B2 | * | 7/2011 | Beaulac | 34/528 |
| 7,975,401 | B2 | * | 7/2011 | Beaulac | 34/601 |
| 2004/0168343 | A1 | | 9/2004 | Park | |
| 2005/0016013 | A1 | | 1/2005 | Bang et al. | |
| 2006/0230632 | A1 | * | 10/2006 | Chiles et al. | 34/528 |
| 2007/0079526 | A1 | * | 4/2007 | Volkers | 34/524 |
| 2010/0011614 | A1 | * | 1/2010 | Doh | 34/493 |

FOREIGN PATENT DOCUMENTS

| | | | | |
|---|---|---|---|---|
| CN | 1712628 | A | | 12/2005 |
| JP | 58-221995 | A | | 12/1983 |
| JP | 58-221996 | A | | 12/1983 |
| JP | 58-221997 | A | | 12/1983 |
| JP | 62-231699 | A | | 10/1987 |
| JP | 63-92397 | A | | 4/1988 |
| JP | 03071013 | A | * | 3/1991 |
| JP | 4-58998 | A | | 2/1992 |
| KR | 94-006248 | B1 | | 7/1994 |
| KR | 10-1996-0014519 | A | | 5/1996 |
| KR | 1996-0013395 | B1 | | 10/1996 |
| KR | 10-2003-0012417 | A | | 2/2003 |
| KR | 10-2005-0021830 | A | | 3/2005 |
| KR | 10-2005-0122469 | A | | 12/2005 |
| WO | WO 2007/119974 | A2 | | 10/2007 |

* cited by examiner

DRYER AND CONTROLLING METHOD THEREOF

TECHNICAL FIELD

The present invention relates to a dryer. More specifically, the present invention relates to a dryer and a controlling method of a dryer, which can sense whether there is a malfunction or can precisely sense a drying rate of laundry.

BACKGROUND ART

Generally, dryers are home appliances that are used to automatically dry damp laundry after washing. The dryers are typically categorized into an air exhaustion-type dryer and an air condensation-type dryer based on a drying method. A structure of the air exhaustion-type dryer will be explained as follows.

FIG. 1 illustrates a conventional air exhaustion-type dryer and FIG. 2 illustrates a passage of air flow in the conventional air exhaustion-type dryer shown in FIG. 1.

In reference to FIGS. 1 and 2, the conventional dryer includes a body 1, a drum 3, a driving part and a heater 5. The body 1 has a door 2 formed on a front surface thereof. The drum 3 is rotatable inside the body 1 and a plurality of lifters 4 are projected from an inner circumferential surface of the drum 3. The driving part supplies a rotational force to the drum 3. The heater 5 heats sucked external air to produce hot air.

In addition, the conventional dryer includes an air suction duct 7, a lint duct 8 and a ventilation fan 13. The air suction duct 7 is connected to a rear opening of the drum 3 to guide hot air from the heater 5 into the drum 3. The lint duct 8 is connected to a front opening of the drum 3 to guide damp air exhausted after drying into an air exhaustion duct 15. The ventilation fan 13 is provided in rear of the lint duct 8 to produce a ventilation force. Also, a lint filter 14 is provided at an end of the lint duct 8 to filter foreign substances such as dust, lint and variations of them from the air exhausted from the drum 3.

The driving part for rotating the drum 3 includes a motor 10, a driving belt 23 that winds around an outer circumferential surface of the drum 3, being connected with a driving pulley 11 fastened to the motor 10. When the driving pulley 11 is rotated by the rotation of the motor 10, the driving belt 12 wound around the driving pulley 11 is rotated to rotate the drum 3.

On the other hand, an electrode sensor 30 is provided in a front portion of the drum 3 to detect a drying rate of the laundry. The electrode sensor 30 is formed of two metal plate that are parallel to sense a drying rate of fabric by using impedence, such that the detected drying rate is outputted as a voltage signal. The impedence is produced at both opposite ends of an electrode based on moisture content when the laundry contacts with both metal plates.

More specifically, a microprocessor (hereinafter, a micom) for controlling an overall system of the dryer receives the voltage signal from the electrode sensor 30 and it determines a drying rate of the laundry based on a level of the voltage to control the operation of the dryer.

DISCLOSURE OF INVENTION

Technical Problem

However, the above conventional dryer has following disadvantages as follows.

First, the direct contact-type method by using the above conventional electrode sensor 30 may not be able to measure an accurate drying rate, because impedence variation according to various kinds of laundries results in deviation of measured impedence values. In addition, it is easy to measure a drying rate during the initial drying that has much moisture, because the impedence is relatively variable. However, as the main drying is performed, the variation of outputted voltage is getting minute. As a result, an auxiliary accurate sensor and detection circuit should be further provided, which brings a problem.

Furthermore, when an inverter controlling method is selected to control the speed of the motor variably, a sensing circuit including the electrode sensor 30 uses a power together with an inverter circuit and also it is connected to one ground together with the inverter circuit. Here, the inverter circuit is operated by an AC power. Since the sensing circuit and the inverter circuit are connected with the same ground not separated, a high voltage is supplied to the sensing circuit.

That is, when a user opens the door and puts his/her hand into the drum, the user might get shock through the electrode sensor 30 and the laundry contacting with the electrode sensor 30.

A still further, if drying is performed without laundry by a user's mistake, this condition of no load can not be sensed in the above conventional dryer and the heating of the heater is neglected for a long time. In addition, an auxiliary means for sensing a malfunction such as a motor lock error, motor belt cutoff and the like may not be provided in the conventional dryer. If there is a malfunction in the above system, the heater is kept on heating in a suspension state of the drum. As a result, product damage or fires might happen because of the heat.

Technical Solution

To solve the problems, an object of the present invention is to provide a controlling method of a dryer.

To achieve these objects and other advantages and in accordance with the purpose of the invention, as embodied and broadly described herein, a dryer having a drum that laundry is stored in and a heater that supplies hot air to the drum, the control method of the dryer includes: a sensing circuit that outputs a pulse signal based on contact with the laundry; and a micom that controls the dryer. The micom determines a drying rate of the laundry or whether there is a malfunction in the dryer based on the pulse signal outputted from the sensing circuit.

Here, the sensing circuit may include an electrode sensor that outputs a voltage signal corresponding to an impedence produced based on contacting with the laundry; a comparator that compares the outputted voltage signal with a predetermined standard voltage to output the comparison result; and a photocoupler that outputs a pulse signal based on a signal outputted by the comparator.

An output stage of the electrode sensor may be connected with an inversion terminal (−) of the comparator and the predetermined standard voltage may be connected with a non-inversion terminal (+) of the comparator. An output stage of the comparator may be connected with a light emitter of the photocoupler and an input port of the micom may be connected with a light collector of the photocoupler.

By the way, it is preferred that the standard voltage is predetermined below a voltage level that is sensed at the electrode sensor when dried laundry contacts with the electrode sensor.

Here, the comparator may output a signal to the photocoupler if the voltage signal outputted from the electrode sensor is substantially higher than the predetermined standard voltage.

The micom may measure the pulse signal per unit hour and the micom determines a drying rate of the laundry based on the pulse number measured per unit hour. That is, the micom compares the pulse number measured per unit hour with a predetermined value to determine whether drying the laundry is complete.

Thus, the micom determines that drying the laundry is complete when the pulse number measured per unit hour reaches the predetermined value.

Here, the predetermined value may be variable in accordance with kinds of drying.

The micom may determine whether there is a malfunction in the dryer based on whether there is the pulse signal outputted from the sensing circuit. That is, the micom determines that there is a malfunction in the dryer, if the pulse signal is not outputted from the sensing circuit for a predetermined time period.

In another aspect of the present invention, a control method of a dryer includes: performing drying by using high temperature hot air; and determining a drying rate of laundry based on a pulse signal produced based on contact between laundry and an electrode sensor during the drying, or determining whether there is a malfunction in the dryer.

Here, determining a drying rate of laundry or determining whether there is a malfunction includes repeatedly reading the pulse signal produced based on the contact between the laundry and the electrode sensor; counting the real pulse signal per unit hour; and determining that drying the laundry is complete, when the pulse number per unit hour reaches a predetermined value.

The control method of the dryer may further includes stopping a motor and a heater when it is determined that drying the laundry is complete.

Determining that drying the laundry is complete when the pulse number per unit hour reaches a predetermined value includes repeatedly reading the pulse signal produced based on the contact between the laundry and the electrode sensor; and sensing whether there is a malfunction in the dryer based on whether there is the pulse signal.

Here, in sensing whether there is a malfunction in the dryer based on whether there is the pulse signal, it is sensed whether the pulse signal is produced for a first predetermined time period to primarily determine whether there is a malfunction in the dryer. If the pulse signal is sensed for the first predetermined time period, the control method of the dryer may further include counting the sensed pulse signal per unit hour; and determining that drying the laundry is complete when the pulse number per unit hour reaches a predetermined value.

If the pulse signal is not sensed for the first predetermined time period, the control method of the dryer may further include stopping a heater and continuously operating a motor by primarily determining that there is a malfunction in the dryer.

After stopping the heater and continuously operating the motor by primarily determining that there is a malfunction in the dryer, the control method of the dryer may further include secondarily determining whether there is a malfunction in the dryer by sensing whether the pulse signal is produced for a second predetermined time period.

If the pulse signal is sensed for the second predetermined time period the control method of the dryer may further include re-operating the heater; counting the sensed pulse signal per unit hour; and determining that drying the laundry is complete when the pulse number per unit hour reaches a predetermined value.

If the pulse signal is not sensed for the second predetermined time period, the control method of the dryer may further includes stopping the motor; and notifying a user that there is a malfunction in the dryer.

Advantageous Effects

The present invention has following advantageous effects.

First, according to the present invention, since a drying rate is determined by the contact number with laundry, not by the direct contact by using an electrode sensor, relatively accurate drying rate determination may be possible, which can optimize drying efficiency.

Furthermore, the drying rate sensing circuit is presented with the structure in that the circuit and the power that requires high power are separated. Thus, danger of user's shock may be reduced, which can enhance reliability of the product.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
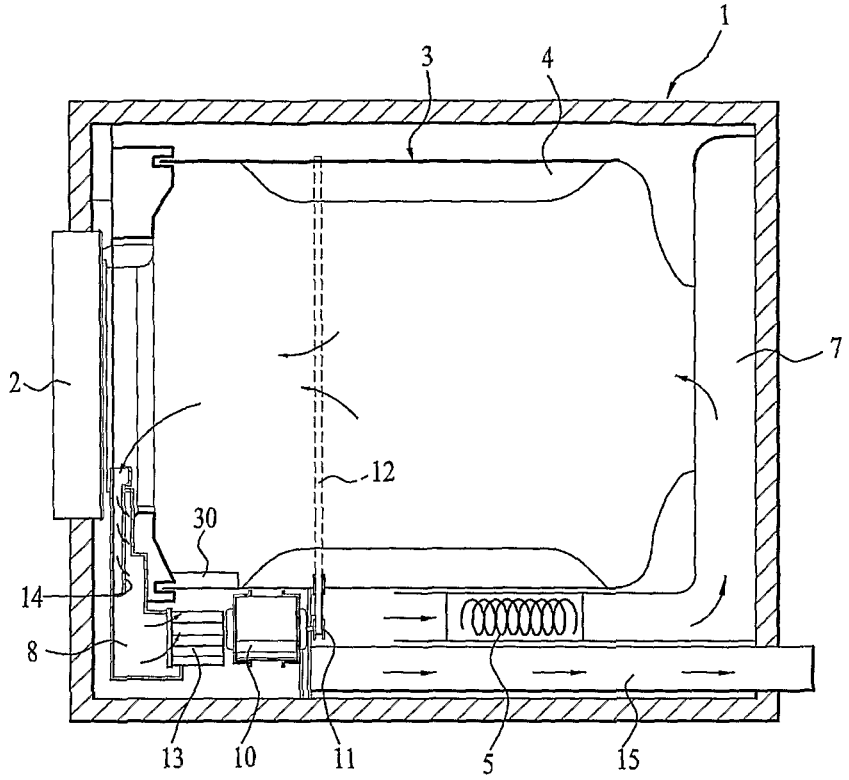
FIG. 1 is longitudinal sectional view illustrating a structure of a conventional air exhaustion-type dryer.
Figure 2:
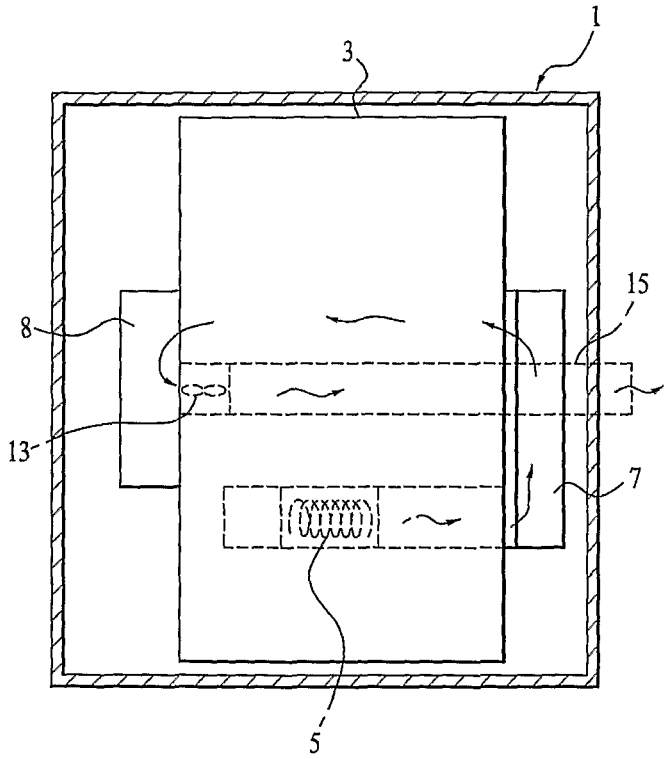
FIG. 2 is a horizontal sectional view illustrating key part of the air exhaustion-type dryer shown in FIG. 1.
Figure 3:
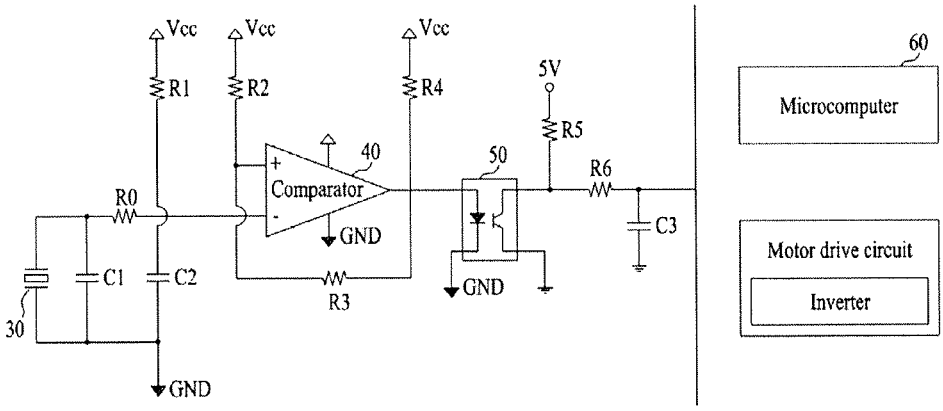
FIG. 3 is a diagram illustrating a control circuit of a dryer according to an embodiment.

FIG. 3 illustrates a control circuit of a dryer according to an embodiment. In reference to FIG. 3, the control circuit of a dryer according to the preferred embodiment will be explained in detail.

As shown in FIG. 3, the control circuit of a dryer according to the embodiment includes a sensing circuit and a micom 60. The sensing circuit outputs a pulse signal based on contact with laundry. The micom 60 determines a drying rate of the laundry based on the outputted pulse signal and it controls an overall drying of the dryer.

The sensing circuit includes an electrode sensor 30, a comparator 40 and a photocoupler 50. The electrode sensor 30 outputs a voltage signal corresponding to an impedence that is produced when the electrode sensor 30 contacts with the laundry. The comparator 40 compares the voltage signal with a predetermined standard voltage and it outputs the comparison result. The photocoupler 50 outputs a pulse signal based on the outputted signal of the comparator 40.

According to the above connection structure of the sensing circuit, an output stage of the electrode sensor 30 is connected to an inversion terminal (−) of the comparator 40. The standard voltage predetermined by a voltage division resistor (R2 and R3) is connected with a non-inversion terminal (+) of the comparator 40. Also, an output stage of the comparator 40 is connected with a light emitter, which is Light Emitting Diode, of the photocoupler 50 and a light collector, which is a phototransistor, of the photocoupler 50 is connected with an input port of the micom 60.

It is preferred that the standard voltage of the comparator 40 is predetermined below a voltage level that is sensed at both opposite ends of an electrode when completely dried laundry contacts with the electrode sensor 30. That is, if the laundry is dried completely, a voltage signal that is below the standard voltage is produced and a pulse signal outputted from the micom 60 is not generated in spite of the contact between the laundry and the electrode sensor 30.

The sensing circuit according to the present invention presents a new type of drying rate sensing method that uses the contact numbers of laundry to determine a drying rate, not using the direct contact numbers. In addition, the sensing circuit according to the present invention may not use a direct contact method by using the electrode sensor 30, such that it can use an auxiliary DC power (5V) and a ground separated from a motor drive circuit including an inverter. The photocoupler 50 is provided in the sensing circuit according to the present invention to electrically insulate between the electrode sensor 30 and the micom 60.

More specifically, when a drum 3 is rotated and the laundry contacts with the electrode sensor 30, a voltage signal corresponding to an impedence produced at both electrode ends of the electrode sensor 30 is generated and voltage signal is inputted at the inversion terminal (−) of the comparator 40.

Hence, the comparator 40 compares the voltage signal of the electrode sensor 30 with the predetermined standard voltage inputted at the non-inversion terminal (+). If the voltage signal that is higher than the predetermined standard voltage is inputted because of not completely dried laundry, the comparator 40 outputs a high signal.

Based on the high signal outputted from the comparator 40, the light emitter of the photocoupler 50 emits light. Thus, the phototransistor that is the light collector is turned on by the light and the pulse signal is transmitted to the micom 60.

That is, whenever the not dried laundry contacts with the electrode sensor 30 once, one pulse signal is produced. If the laundry is completely dried and the voltage signal below the standard voltage is outputted, the pulse signal is not produced in spite of the laundry contacting with the electrode sensor 30.

The micom 60 counts the number of the pulse signal outputted from the photocoupler 50 per unit hour, for example, 1 minute and it uses the pulse number per unit hour (pulse number/1 min.) to determine a drying rate of laundry and a drying completion time.

More specifically, the higher is the proportion of the laundry that is not completely dried, the higher is the pulse number per unit hour. The higher is the proportion of the laundry that is completely dried, the smaller is the pulse number per unit hour. As a result, the predetermined pulse number per unit hour is inputted as a predetermined value and it is determined that drying is complete, if the measured pulse number per unit hour reaches the predetermined value.

Figure 4:
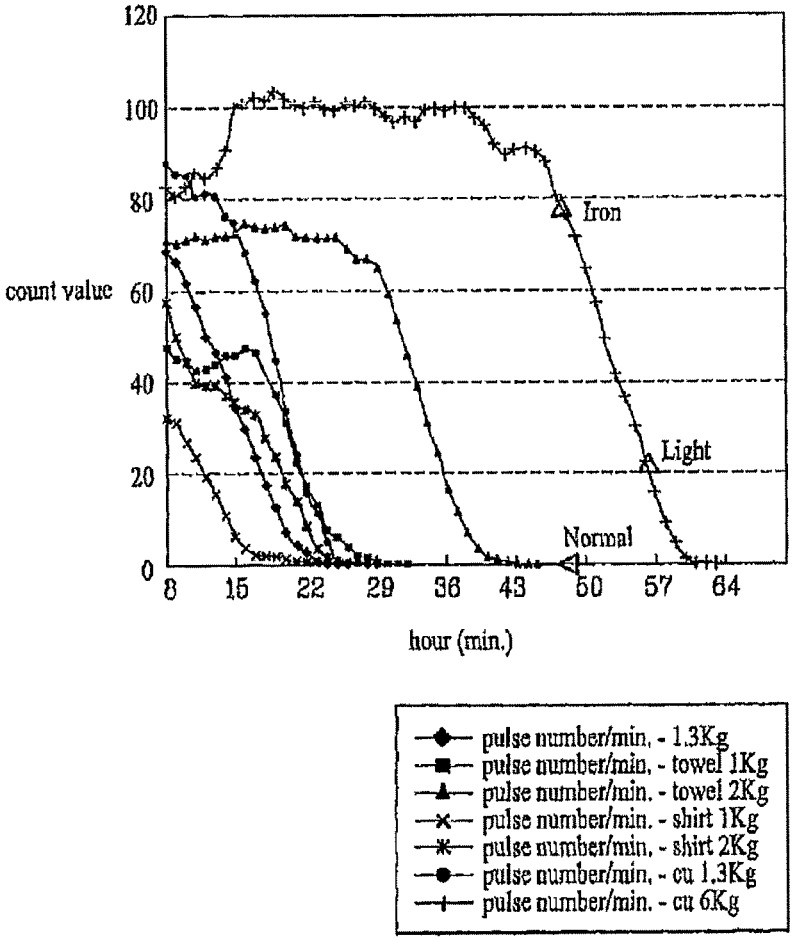
FIG. 4 is a graph illustrating the pulse number of laundry per unit hour based on the time passing by using the control circuit shown in FIG. 3.

On the other hand, the applicant has performed experiments in that the pulse number per unit hour is measured based on the kind and amount of laundry. FIG. 4 is the result of counting the pulse number per unit hour according to the experiments and FIG. 4 is a graph illustrating a counting value of the pulse signal per minute.

In reference to FIG. 4, most of laundry is damp during an initial drying and thus the pulse umber per unit hour based on the contact between the laundry and the electrode sensor 30 is high. As main drying is performed and dried laundry is increasing, the pulse number per unit hour is getting low.

A target drying rate is variable according to the kind of drying, for example, Iron, Light and Normal. As a result, the pulse number per unit hour corresponding to the target drying rate is searched and predetermined in a system. That is, if the pulse number per unit hour based on the contact between the laundry and the electrode sensor 30 is getting lower and reaches the predetermined value during the drying, it is determined that drying the laundry is complete.

For example, if the predetermined value corresponding to Normal mode is 0 (zero), the pulse number per unit hour reaches 0 and it is determined that the pulse number reaches a target drying rate, which means that drying the laundry is complete.

On the other hand, if the laundry is not introduced inside the drum 3, which is called no-load, the laundry that contacts with the electrode sensor 30 may not exist. Even when the drum 3 is stopped because of a malfunction of the system, relative motion between the electrode 30 and the laundry does not exist and thus the pulse signal is not produced from the sensing circuit.

As a result, no-load inside the drum 3 and suspension state of the drum 3 caused by a motor lock error or cutoff of a motor belt 112 may be sensed by using whether the laundry is contacting or the number of the contact between the laundry and the sensing circuit.

Figure 5:
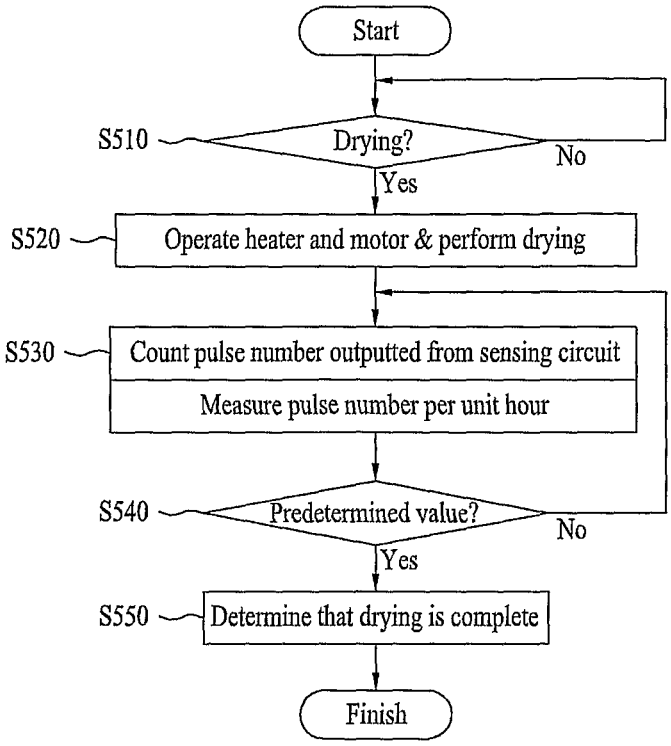
FIG. 5 is a flow chart illustrating a control method of a dryer by sensing a drying rate of laundry according to the embodiment.

FIG. 5 is a flow chart illustrating a control method in that a drying rate of laundry is sensed to control a dryer according to an embodiment.

In reference to FIG. 5, the control method of a dryer by sensing a drying rate according to the present invention having the above sensing circuit will be now explained.

First, when a user introduces damp laundry inside the drum 3 and inputs a start command (S510), the micom 60 senses the start command and operates the motor 10 to operate the drum 3 and a ventilation fan 13.

The heater 5 is operated and it heats external air that is sucked by the ventilation fan 13. After that, the air is forcibly drawn into the rotating drum 3 through the air suction duct 7. At this time, hot air that is drawn into the drum 3 evaporates moisture of the laundry to dry the laundry. Thus, the hot air becomes low temperature high humidity air and it passes the lint duct 8 and the exhaustion duct 15 before being exhausted outside (S520).

While above process is repeated during the drying, the micom 60 receives the pulse signal from the sensing circuit and it counts the pulse number per unit hour (S530).

It is determined whether the pulse number counted per unit hour reaches the predetermined value (S540). If the pulse number measured per unit hour reaches the predetermined value, it is determined that drying the laundry is complete and all courses of the drying are finished (S550).

Figure 6:
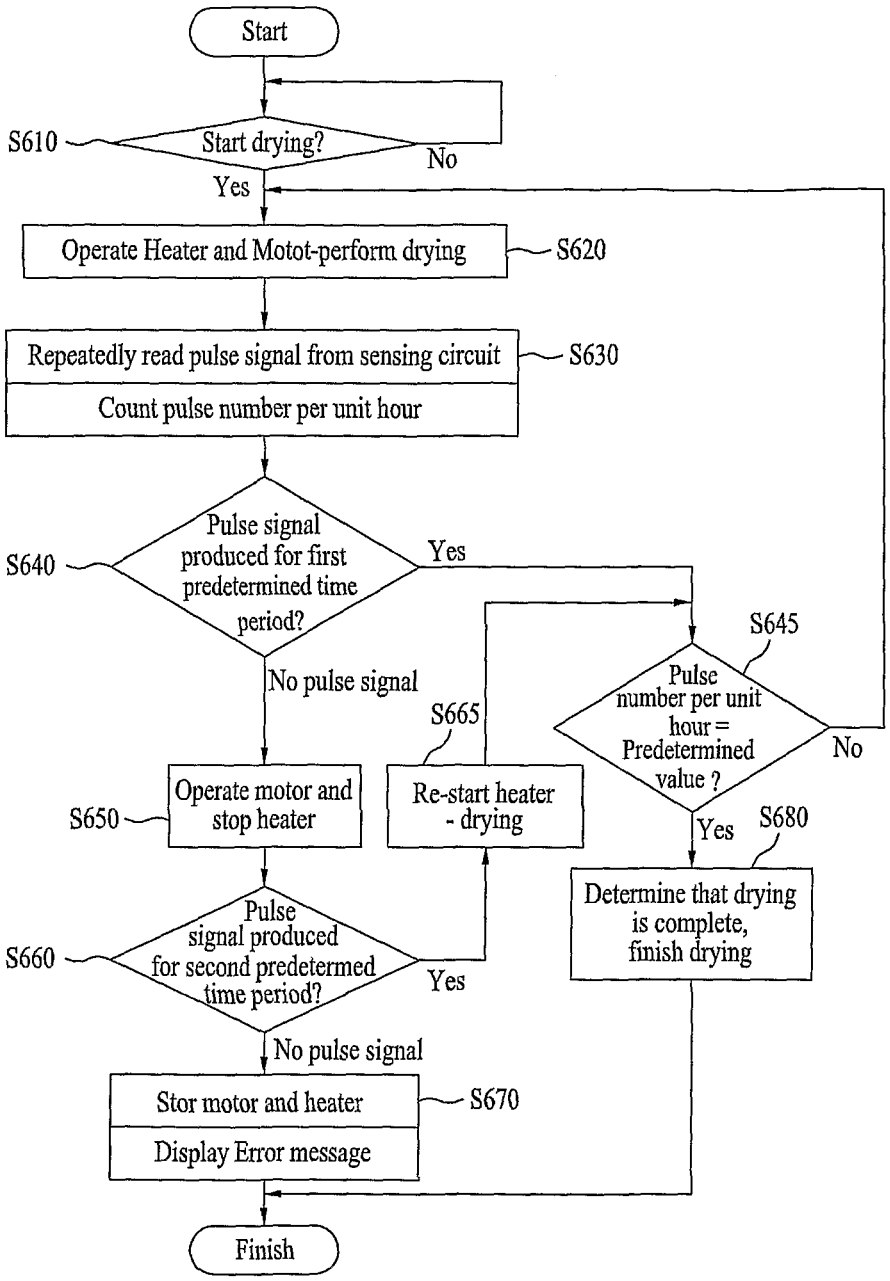
FIG. 6 is a flow chart illustrating a control method of a dryer by sensing whether there is a malfunction according to another embodiment.

On the other hand, FIG. 6 is a flow chart illustrating a control method of a dryer by sensing whether there is a malfunction in a dryer according to another preferred embodiment.

In reference to FIG. 6, the control method of the dryer according to the present invention having the sensing circuit will now be explained in detail.

When a user introduces damp laundry inside the drum 3 and inputs a start command (S610), the micom 60 operates the motor 10 and operates the drum 3 and the ventilation fan 13.

Hence, the heater 5 is operated and it heats external air that is drawn by the ventilation fan 13. The air is forcibly drawn into the rotating drum 3 through the air suction duct 7. At this time, hot air that is drawn into the drum 3 evaporates moisture of the laundry to dry the laundry. Thus, the hot air is changed into low temperature and high humidity air and the air passes the lint duct 8 and the air exhaustion duct 15 to be exhausted outside.

Drying that uses high temperature and dry hot air is performed by the above process (S620).

During the drying, the micom 60 determined whether the pulse signal is outputted from the sensing circuit. If the pulse signal is outputted, the micom 60 counts the pulse number per unit hour (S630).

When determining whether the pulse signal is outputted the micom 60 determines whether the pulse signal is outputted for a first predetermined time period, for example, 2 minutes after drying starts (S640).

Based on the result (S640), if the pulse signal is outputted, it is determined that the dryer is performed normally. Hence, the heater 5 and the motor 10 are kept on operating to continuously perform drying. It is determined whether the pulse number counted per unit hour during the drying reaches the predetermined value, which is a determination criterion of drying completion (S645).

Hence, if the pulse number per unit hour reaches the predetermined value, it is determined that drying the laundry is complete, such that all the drying is finished (S680).

If the pulse signal is not outputted for the first predetermined time period after drying starts, it is primarily determined that there is a malfunction in the dryer and thus the heater 5 is stopped in a state of the motor 10 operating (S650).

It is preferred that the operation of the heater 5 is stopped to prevent the temperature inside the drum 3 from increasing, if the pulse signal is not outputted for the first predetermined time period. In addition, no-pulse signal means a malfunction in the dryer but it might mean a simple sensing failure of the pulse signal and thus motor 10 should be continuously operated.

Hence, it is determined whether the pulse signal is outputted for a second predetermined time period, for example, 8 minutes after drying starts and it is secondarily determined whether there is a malfunction in the dryer (S660).

At this time, If the pulse signal is sensed for the second predetermined time period, not for the first predetermined time period, it does not mean no-load or drum suspension state and thus the operation of the heater 5 re-starts (S665). Hence, the pulse number per unit hour is compared with the predetermined value and it is determined whether drying the laundry is complete (S645).

If the pulse signal is not outputted for the second predetermined time period, it is determined that a malfunction substantially happened in the dryer and thus the operation of the motor 10 as well as the operation of the heater 5 is stopped to stop all the drying processes (S670). At this time, it is preferred that an error message is outputted to display a system error by means of a display part of the dryer.

That is, if the pulse signal is not outputted for the second predetermined time period, it is determined that there is no-load or drum suspension state and it is preferred that an overall operation of the system is stopped to prevent accidents such as product damage or fires.

As mentioned above, a new type of a sensing circuit is presented that uses the contact number with the laundry, not the direct contact by using the electrode sensor. As a result, it can be sensed whether there is a system malfunction in a dryer and a drying rate of laundry during the drying can be also sensed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has an industrial applicability.

First, according to the present invention, since a drying rate is determined by the contact number with laundry, not by the direct contact by using an electrode sensor, relatively accurate drying rate determination may be possible, which can optimize drying efficiency.

Furthermore, the drying rate sensing circuit is presented with the structure in that the circuit and the power that requires high power are separated. Thus, danger of user's shock may be reduced, which can enhance reliability of the product.

The invention claimed is:

1. A dryer comprising:

a drum that laundry is stored in;

a heater that supplies hot air to the drum;

a motor for rotating the drum;

a motor drive circuit for driving the motor, the motor drive circuit including an inverter;

a sensing circuit that outputs a pulse signal based on contact with the laundry; and a micom that controls the dryer, wherein the micom determines a drying rate of the laundry or whether there is a malfunction in the dryer based on the pulse signal outputted from the sensing circuit, and wherein the sensing circuit comprises:

an electrode sensor that outputs a voltage signal corresponding to an impedance produced based on contacting with the laundry;

a comparator that compares the outputted voltage signal with a predetermined standard voltage to output the comparison result; and an auxiliary DC power supply, the DC power supply being electrically separate from the motor drive circuit, wherein the sensing circuit is ground separately from the motor drive circuit, wherein the output of the comparator is connected to the standard voltage, and wherein an inversion terminal of the comparator is connected to ground through the electrode sensor and a non-inversion terminal is connected to the standard voltage.

2. The dryer as claimed in claim 1, wherein the sensing circuit further comprises a photocoupler that outputs a pulse signal based on a signal outputted by the comparator, and wherein the predetermined standard voltage of the comparator is below a voltage level that is sensed by the electrode sensor when dried laundry contacts the electrode sensor.

3. The dryer as claimed in claim 2, wherein an output stage of the comparator is connected with a light emitter of the photocoupler and an input port of the micom is connected with a light collector of the photocoupler.

4. The dryer as claimed in claim 2, wherein the comparator outputs a signal to the photocoupler if the voltage signal outputted from the electrode sensor is substantially higher than the predetermined standard voltage.

5. The dryer as claimed in claim 1, wherein the micom measures the pulse signal per unit hour and the micom determines that drying the laundry is complete when the pulse number measured per unit hour reaches the predetermined value, and the predetermined value is variable in accordance with kinds of drying.

6. The dryer as claimed in claim 1, wherein the micom determines that there is a malfunction in the dryer if the pulse signal is not outputted from the sensing circuit for a predetermined time period.

7. The dryer as claimed in claim 1, wherein the comparator is electrically insulated between the electrode sensor and the micom.

* * * * *